US010413908B2

(12) United States Patent
Plumb

(10) Patent No.: US 10,413,908 B2
(45) Date of Patent: Sep. 17, 2019

(54) HAMMER MILL HAMMER WITH NON-CIRCULAR ROD HOLE IN INNER BEARING RACE

(71) Applicant: Jacobs Corporation, Harlan, IA (US)

(72) Inventor: Chad J. Plumb, Harlan, IA (US)

( * ) Notice: Subject to any disclaimer, the term of this patent is extended or adjusted under 35 U.S.C. 154(b) by 773 days.

(21) Appl. No.: 15/093,199

(22) Filed: Apr. 7, 2016

(65) Prior Publication Data

US 2017/0291175 A1 Oct. 12, 2017

(51) Int. Cl.
*B02C 13/28* (2006.01)

(52) U.S. Cl.
CPC ..... *B02C 13/28* (2013.01)

(58) Field of Classification Search
CPC ..... B02C 13/00; B02C 13/28; B02C 13/2804; B02C 13/2808; B02C 13/2812
See application file for complete search history.

(56) References Cited

U.S. PATENT DOCUMENTS 1,433,042 A 10/1922 Sedberry
1,760,097 A 1/1928 Williams
1,829,325 A 10/1928 Alfred
1,827,986 A 1/1929 Iglehart
1,803,148 A 2/1929 Sheppard
1,889,129 A 11/1930 Nielsen
1,954,175 A 7/1931 Jensen
2,237,510 A 8/1939 Tankersley
2,647,695 A 11/1950 Rogers
2,602,597 A 6/1951 Ball
2,763,439 A 12/1954 Mankoff
2,886,117 A 5/1955 Benson
3,045,934 A 8/1961 Eilers
3,482,789 A 12/1969 Newell
3,598,008 A 8/1971 Jacobson
3,844,494 A 10/1974 Hightower
4,129,262 A 12/1978 Lowry
4,142,687 A 3/1979 Potwin
4,856,170 A 8/1989 Kachik
5,002,233 A 3/1991 Williams
5,377,919 A 1/1995 Rogers
5,598,981 A 2/1997 Hellmich
6,419,173 B2 7/2002 Balvanz
7,140,569 B2 11/2006 Young
7,419,109 B1 9/2008 Ronfeldt
8,033,490 B1 10/2011 Young
8,104,177 B2 1/2012 Plumb et al.
8,342,435 B2 1/2013 Plumb et al.

*Primary Examiner* — Matthew Katcoff

(57) ABSTRACT

An improved hammermill hammer with a connection end having a bearing race in the hammer body and a bearing received in said bearing race, the bearing having a non-circular, elongated, elliptical, oval or egg shaped inner bearing surface for receiving a hammer rod there through to prevent the hammer from sticking to the hammer rod.

22 Claims, 6 Drawing Sheets

HAMMER MILL HAMMER WITH NON-CIRCULAR ROD HOLE IN INNER BEARING RACE

FIELD OF THE INVENTION

The present invention relates to an improved hammermill hammer. More particularly, this invention relates to an improved two piece hammer having a bearing received in a bearing race in the connection end of the hammer, and said bearing having an inner non-circular, oval, egg shaped or elongated inner bearing surface providing a rod hole for receiving a hammer rod there through. Additionally, the hammer may have scalloped side etches at the contact end of the hammer.

BACKGROUND AND DESCRIPTION OF RELATED PRIOR ART

Hammer mills have long been used for grinding or comminution of various materials. A typical hammer mill comprises a rotor assembly mounted on a rotor shaft inside a housing. A rotor assembly 1100 is illustrated at rest in FIGS. 11 and 13 of Plumb et al. U.S. Pat. No. 8,104,177, which patent is incorporated herein by reference. A material inlet is generally located at the top of the housing with one or more material outlets located near the bottom of the housing. As shown in FIGS. 11 to 13 of the Plumb et al. '177 patent, the rotor assembly 1100 includes a drive shaft and rows of hammers 1400, as illustrated in FIG. 14 of the Plumb et al. '177 patent. The hammers 1400 are pivotally connected to the rotor 1100 by a steel hammer rod or pin. The hammers are normally flat steel blades or bars, as illustrated in FIGS. 11 to 14. The hammers extend out substantially radially from the hammer rods due to inertia when the hammermill is (rotating) in operation, as illustrated in FIG. 12. The rotor assembly 1100 is mounted inside a housing, known by those skilled in the hammer art as a grinding or working chamber. In a reversible hammer mill, this grinding chamber comprises a cutting plate mounted on either side of the material inlet. Reversible hammer mills are capable of rotation in either direction, a feature providing increased life for the hammers 1400, cutting plates, and screen plates. Sedberry, U.S. Pat. No. 1,433,042 shows reversible hammers (FIG. 5 and lines 38 to 41 on page 3). Williams, U.S. Pat. No. 1,760,097 shows reversible hammers (lines 12 to 17 on page 1). Plumb et al., U.S. Pat. No. 8,104,177 teaches reversible hammer mills are well known in the hammer art (lines 35 to 38 of col. 1).

Present-day cutting plates comprise an upper, linear section, and do not allow particles to escape. Downstream of the cutting plate, the interior of the working chamber is defined by curved screen plates. The screen opening diameter is selected to match the desired final particle size of the material being comminuted. Particles less than or equal to the desired size exit the chamber though the screens, while material greater than the desired size are further reduced by the rotating hammers 1400.

Numerous industries rely on hammer mill grinders or impact grinders to reduce material to a smaller size. For example, hammer mills are often used to process forestry products, agricultural products, minerals, and materials for recycling. Specific examples of materials processed by hammer mills include corn, grains, animal feeds, pet food, feed ingredients, mulch, wood, hay, plastics, and dried distillery grains. Hammer mills heretofore have long been employed to effect size reduction of such diverse materials such as scrap metal including auto bodies, paper, animal and human feed, and anything else that need to be reduced in size.

Standard hammers, when grinding or comminuting materials, impact the product to be pulverized to create a smaller size particle. This impact forces material against a perforated screen area and cuts and sizes the product. Inside the typical hammer mill, numerous forces act. Forces exist at the contact end of the hammer, where the hammer impacts the material being comminuted. Present inside the mill are axial forces, parallel to the rotor shaft, exerted on the sides of the hammers by the materials fed into and passing through the mill. The combination of these forces on the hammers causes elongation of the hammer rod hole, decreased hammer life, and eventual failure of the hammer. Hammer failure results in costly shutdown of the mill and hammer replacement time. Accordingly, there is a need for a hammer design to compensate for impact loading, side loading, wear, and hammer rod hole elongation. Plumb et al., U.S. Pat. Nos. 8,104,177 and 8,342,435, which are incorporated herein by reference, illustrate hammers having a circular bearing race in the connection end of the hammer body, and received therein a circular bearing having a circular inner surface or race which receives a hammer rod (FIG. 6). The combination permits the hammer to move in the rotary, as well as in the axial direction.

All conventional free swinging hammers have a hole diameter that is larger than the rod diameter it is installed upon. The typical diameter oversize is 0.030"; when the hammer is loaded the bearing surface between the rod and the hammer hole initially is a just a tangent point as the rod radius and the hole radius are not equal; through loading the hole deforms and the radiuses become the same. Deformation in a hardened material however is a leading cause of hammer failures. Having an elongated, oval, or egg shape hole allows the hammer hole to be oversized in portions of the hole for installation but upon loading the upper portion of the hole will have the same radius as the rod it is installed upon. This increases the surface area of support in the rod hole in end minimizing stress on the hammer to rod connection point and mitigating deformation. As hammers are in operation the product being milled can become entrapped between the hammer and the rod causing the hammers to stick and not free swing upon start-up and shutdown causing vibration in the mill. Increasing the hole size can mitigate this issue but drastically increases the point load on the hammer and rod. Having an inner oval, egg-shaped or elongated hole allows the hammer to have a matched radius contact point and a larger void at the bottom of the rod, increasing the area between the rod and the hammer allowing the milled material to escape to mitigate hammer sticking issues.

The Plumb et al. patents also show a well known expedient of providing hardened material 22 added to edge portions of the contact end of the hammer, preferably by welding, to increase hammer life. See also Newell, U.S. Pat. No. 3,482,789 (lines 12 to 18 of column 4); Kachik, U.S. Pat. No. 4,856,170 (lines 55 to 68 of column 8); and, Lowry U.S. Pat. No. 4,129,262. Welding of tungsten carbide onto the contact surfaces of hammers is well known in the art, as illustrated in the Young U.S. Pat. No. 7,140,569 (lines 9 to 17 of column 3); Young, U.S. Pat. No. 8,033,490 (lines 28 to 36 of column 9); Balvanz, U.S. Pat. No. 6,419,173 (lines 11 to 16 of column 3); Rogers, U.S. Pat. No. 2,647,695 (lines 37 to 41 of column 2); Mankoff, U.S. Pat. No. 2,763,439 (lines 26 to 31 of column 1); and, Eilers, U.S. Pat. No. 3,045,934 (lines 44 to 54 of column 2). Hammers produced by Jacobs Corporation, as illustrated in Ronfeldt et al., U.S.

Pat. No. 7,419,109, included hardened material, such as tungsten carbide, welded on the contact edges of hammer mill hammers.

The hammers of the preferred embodiments herein include scalloped portions on the leading and trailing edges of the contact ends of the hammers. These scalloped edge portions of the contact end of the hammers may include tungsten carbide welded on the surface thereof. Hammers with triangular and/or square notches in the contact side edges of hammers are known in the prior art. See Williams, U.S. Pat. No. 1,760,097; Iglehart, U.S. Pat. No. 1,827,986; Alfred, U.S. Pat. No. 1,829,325; and, Jensen, U.S. Pat. No. 1,954,175. Tankersley, U.S. Pat. No. 2,237,510, shows grooves in the sides of a hammer extending from the contact end toward the connection end. Williams, U.S. Pat. No. 5,002,233, shows a circular cut in the contact edges of a hammer.

Manufacturing methods utilizing casting, forging, heat treatment and rolled steel are well known in the art to improve the life and functionality of the hammer. Nielsen, U.S. Pat. No. 1,889,129, teaches casting hammermill hammers (lines 35 to 40 on page 1). Ball, U.S. Pat. No. 2,602,597, teaches case hardening hammers parts, a heat treatment, to increase wear life (lines 51 to 56 on page 1). Rogers, U.S. Pat. No. 5,377,919, teaches heat treating hammers (lines 30 to 33 of col. 4). Plumb et al., U.S. Pat. No. 8,104,177 teaches manufacturing methods utilizing forging, rolling and casting are well known in the hammer art to improve grinding characteristics, and life and functionality of the hammers. Young, U.S. Pat. No. 7,140,569, teaches forging (lines 20 to 27 of col. 3). Young, U.S. Pat. No. 8,033,490, teaches forging is preferred because it produces a much strong hammer than casting, but that other methods such as casting, rolling, stamping, machining and welding are known to those of ordinary skill in the art (lines 7 to 17 of col. 13). Young, '490, also teaches a multiple-blade hammer may be heat treated for hardness (line 5 to 13 of col. 15).

The hammers of the present invention have a non-circular, elongated, oval or egg-shaped hole in the inner bearing race, on the inside of the circular bearing received on the inside of the outer bearing race in the connection end of the hammer body. Hellmich, U.S. Pat. No. 5,598,981, shows hammers with a circular hammer rod hole, wherein the circular hammer rod hole is significantly larger in diameter than the hammer rod. The hammer rod in Hellmich is provided with a cam shaped portion such that upon rotation of the hammer rod the hammer length is adjusted radially to compensate for wear at the contact end of the hammer. Jacobson et al., U.S. Pat. No. 3,598,008, shows a hammer wherein the hammer rod hole consists of two overlapping circular sections, a smaller diameter circular section situated toward the end of the hammer for receiving a hammer rod of substantially the same diameter, and a substantially larger diameter circular section overlapping the smaller diameter circular section and situated toward the contact end of the hammer. Benson, U.S. Pat. No. 2,886,117, shows hammers affixed to plates P by pivot pins 27. The plates have two overlapping circular holes for receiving the pivot pins, the radially outermost circular hole having a smaller diameter for receiving the pivot pins, and the innermost circular hole having a larger diameter. Sheppard, Jr., U.S. Pat. No. 1,803,148, shows a two-piece hammer having a first portion including a circular rod hole at the connection end thereof, and a second end portion thereof having plural arms extending radially therefrom. The ends of the arms have holes for receiving a bolt there through, which bolt holds plural hammer heads. The hole in the hammer heads through which the bolt passes are elongated. Potwin, U.S. Pat. No. 4,142,687, similarly shows two piece hammers, the connection piece having a first portion with a circular rod hole for receiving a hammer rod and a second portion having a slot 32 for receiving securing cross pin 42 and spacers 54. Hightower, U.S. Pat. No. 3,844,494 shows a circular hole having a hardened bushing with a circular inner hole therein for receiving a hammer rod there through (lines 60-66 of col. 3).

All of the prior art patents referred to in this document are hereby incorporated by reference herein in their entirety.

BRIEF DESCRIPTION OF THE DRAWINGS

The following is a brief description of the drawings, which best be understood when studied in connection with the drawing themselves and the "DETAILED DESCRIPTION" which follows this brief description.

As illustrated in FIG. 4, the hammer connection end 13 has a circular bearing race 2 with a circular bearing 3 received therein, which circular bearing 3 has an oval inner hole or bearing race (as shown in FIG. 2) which receives hammer rod 5. As shown in FIG. 4, the bearing race-bearing-oval bearing rod hole combination, permits not only rotation of the hammer in a radial plane perpendicular to the axis of the hammer rod, but also limited rotation the hammer as shown by arrow 20, and also limited swing in an axial direction as indicated by arrows 21. The hammer can move in the rotary and axial directions in response to forces applied by material passing through the hammermill. This reduces the chance of hammer damage from impact with foreign objects, such as pieces of tramp metal, coming into the hammermill with the material being comminuted; as well as, forces applied to the hammer by the material being comminuted;

DETAILED DESCRIPTION OF THE INVENTION

Figure 1:
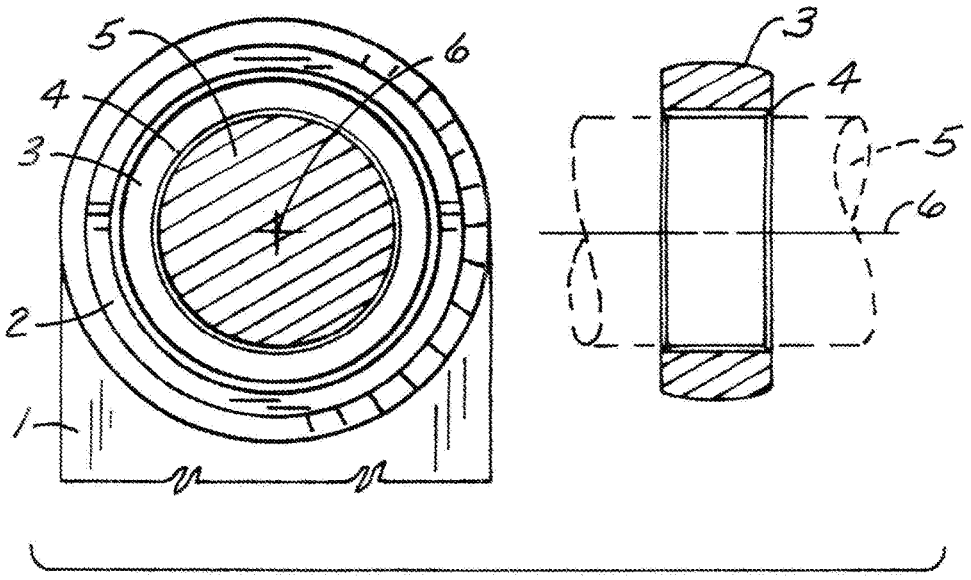
Fig. 1 Prior Art
FIG. 1 illustrates a prior art Hammer 1, similar to the hammers shown in FIGS. 6 and 7 of the Plumb et al., U.S. Pat. No. 8,104,177. The connection end of the hammer includes a circular bearing race 2, with a circular bearing 3 received therein. The rod hole 4 in the bearing, which receives circular hammer rod 5, is circular. The center 6 of the hammer rod 5 is the same as the center of the circular rod hole 4.
Figure 6:
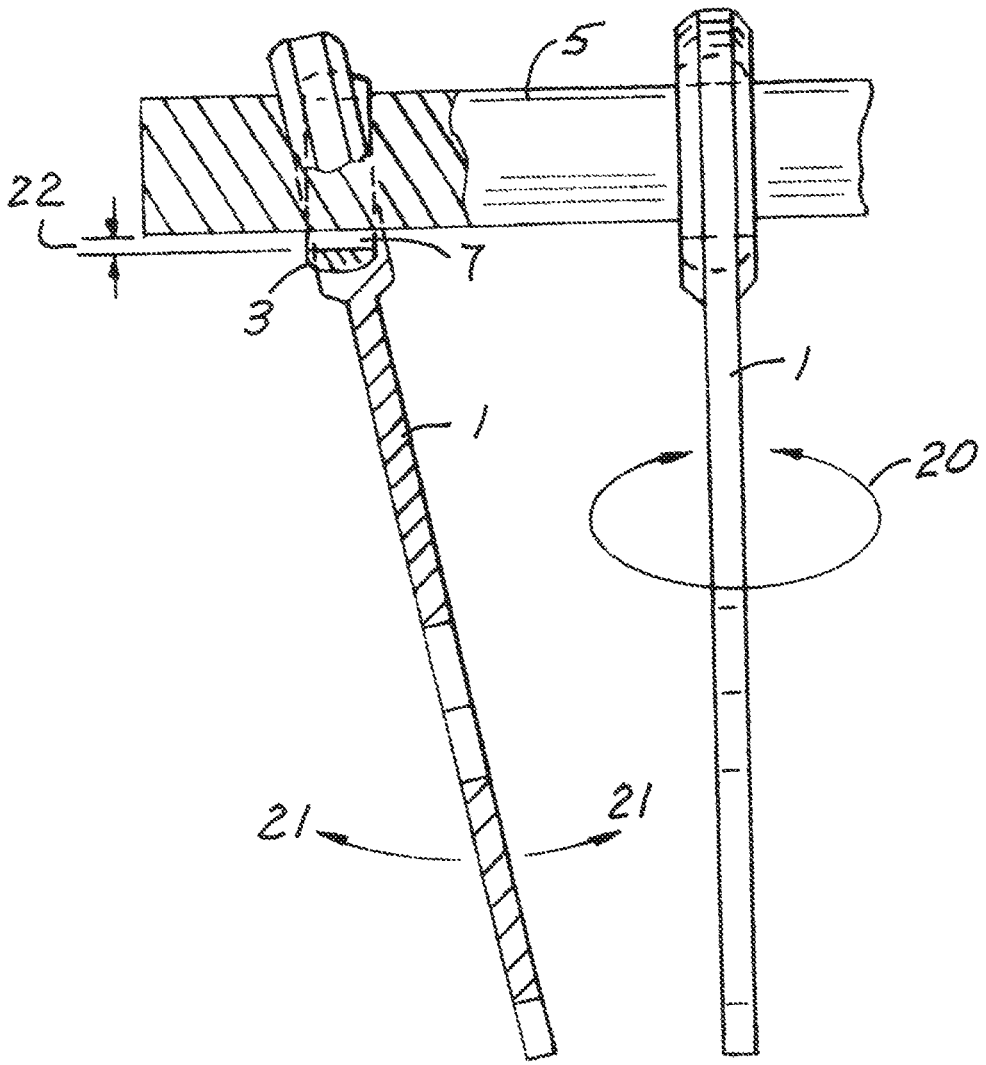
FIG. 6 is a cross sectional view taken along line 6-6 of FIG. 5 and shows an edge-on view of two of the hammers of the preferred embodiments, the left one of which is cut away along the center of the hammer and of the hammer rod. Arrows 21 and arrow 20 in FIG. 6 illustrate the limited swing rotation of the hammers permitted by the bearing race-bearing-non-circular rod hole combination. The lines indicated at 22, illustrate the amount of offset of the first circular section or cut from the second circular section or cut, which offset results in the oval rod hole 7 in the circular bearing 3.
Figure 7:
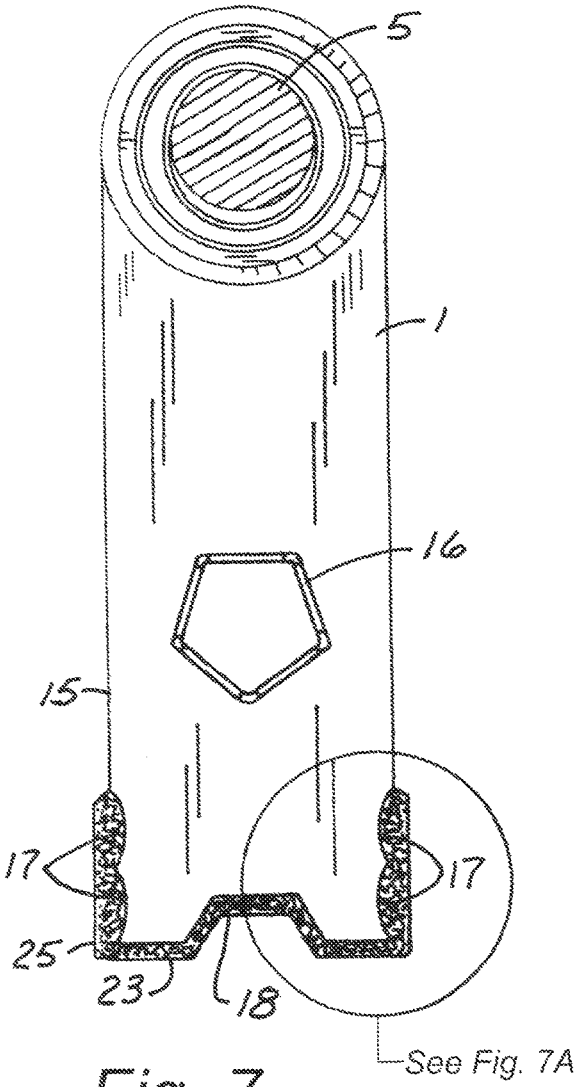
FIG. 7 illustrates the preferred embodiment of the inventive hammer, wherein the scalloped side edges 17 and the bottom edge 23 of the contact end 15 have hardened material 25, such as tungsten carbide, welded thereon. The hardened material 25 is of a thickness that it fills the scalloped portions 17. The thickness of the hardened material 25 preferably, as shown in FIG. 7, is greater than the depth of the scalloped portions 17, to provide an additional protective layer over the filled scalloped portions. The notch 18 provides improved comminution, by contact and rebounding of the material being comminuted in the notch.

Referring now to the drawing, wherein like reference numerals designate identical or corresponding parts throughout the several figures, FIG. 1 illustrates the connection end of a prior art hammer 1, similar to the hammers shown in FIGS. 6 and 7 of the Plumb et al., U.S. Pat. No. 8,104,177, which patent is incorporated herein by reference. The connection end of the hammer 1 includes a circular bearing race 2, with a circular bearing 3 received therein. The rod hole or inner bearing 4 race on the inside of the bearing, which receives circular hammer rod 5, is circular. The center 6 of the hammer rod 5 is the same as the center of the circular rod hole or inner bearing race 4.

Figure 2:
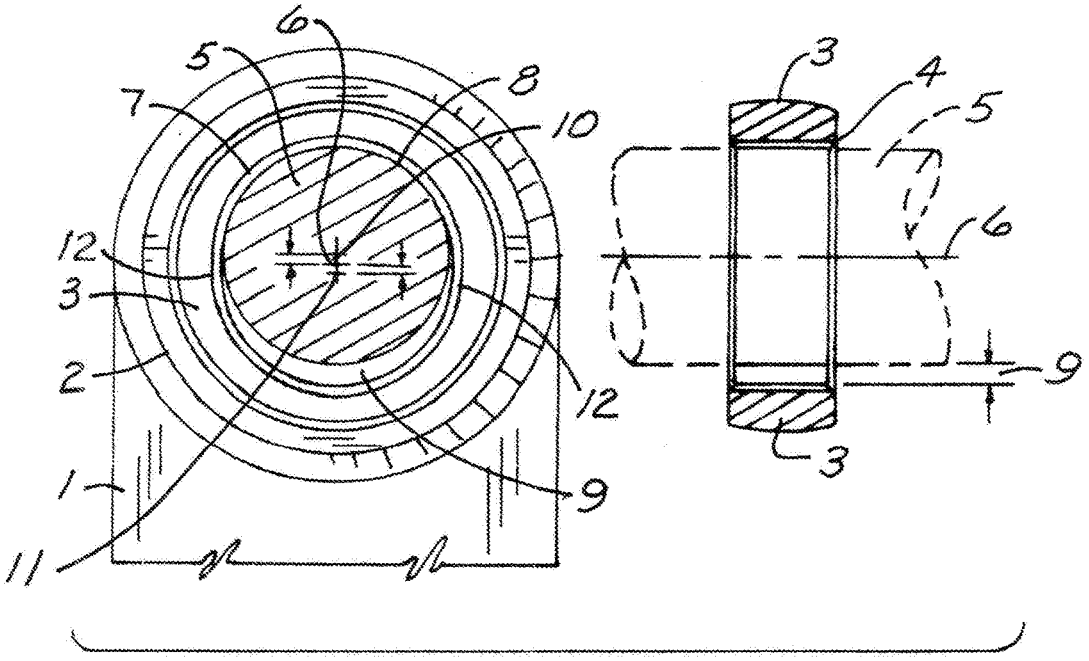
FIG. 2 illustrates a first embodiment of the present invention wherein the connection end of the hammer 1 includes a circular bearing race 2, with a circular bearing 3 received therein. The rod hole or inner bearing race 7 of the present invention differs from circular rod hole 4 in the bearing 3 of the prior art in that the rod hole of formed by inner bearing race 7 of the present invention is non-circular, elliptical, oval, egg shaped or elongated in shape. In one embodiment of the present invention, the hole 7 is formed in two sections, a first circular section or cut 8 and a second circular section or cut 9, both being arcs formed around different centers but both having the same radius dimension. The center 10 of the first circular section or cut 8, as shown, substantially corresponds to the center 6 of the hammer rod 5. The center 11 of the second circular section or cut 11 is offset from the center of the second circular section or cut 10. The first circular section or cut 8 and the second circular section or cut 9 are connected by straight or slightly convexly arcuate portions indicated at 12. The hammer rod as shown is positioned in the first section or cut 8 of the non-circular shaped hole 7 in the inside of bearing 3. However, it is to be understood that the bearing may rotate during installation of the hammer, during start-up of the hammer mill, and/or during operation of the hammer mill, and the hammer rod 5 may end up positioned in the second section or cut 9, or for a time between the first or second circular sections or cuts, as illustrated in FIG. 8.

FIG. 2 illustrates a preferred connection end of the hammermill hammer of the present invention. The preferred connection end of hammer 1 includes a circular bearing race 2 and a circular bearing 3 received therein. Contrary to the circular rod hole or circular inner bearing race 4 in the bearing 3 found in the prior art, the rod hole or inner bearing race 7 in the bearing 3 in the present invention is non-circular, oval, elliptical, egg-shaped or elongated in shape. The hole 7 is composed of two sections or cuts, a first circular section or cut 8 and a second circular section or cut 9. The center 10 of the first circular section or cut 8, as shown in the embodiment of the present invention depicted in FIG. 2, substantially corresponds to the center 6 of the hammer rod 5. The center 11 of the second circular section or cut 11 is radially offset from the center of the second circular section or cut 10. The first circular section or cut 8 and the second circular section or cut 9 are connected by straight or slightly convexly arcuate portions indicated at 12. The radius of the upper arc and of the lower arc of the ellipse in FIG. 2 are identical, though they do not need to be identical.

The combination of circular bearing race in the connection end of the hammer, the circular bearing received in the bearing race, and the non-circular, oval, elliptical, egg-shaped or elongated rod hole 7 in the bearing 3, of the preferred embodiment hammer permits the hammer to rotate in a plane perpendicular to the hammer rod, limited rotation about the axis of the hammer, and limited swing in the direction of movement of material passing through the hammermill. The oval nature of the rod hole or inner bearing race 7 also allows limited motion of the hammer 1 on the hammer rod 5 as indicated by arrow 25 in FIG. 5. The oval nature of the rod hole 7 opens up an area under the rod to aid in installation, start-up, shut down and removal.

The non-circular nature of the rod hole 7 provides the benefits of easy assembly and removal of the hammer, as well as, an area for escape of material being comminuted which may enter or lodge in the between the hammer rod and the inner surface of the bearing. The embodiment of the inventive hammer wherein the rod hole 7 is oval in shape provides enhanced wear characteristics of the hammer connection end by providing two areas of major contact of the hammer rod and the bearing, i.e., the first and second sections or cuts 8 and 9. The double cut forming the oval rod hole or inner bearing race provides pockets for receiving hard facing. The hammers of the present invention may be cast or forged, for example. The inventive hammers can be used with spacers such as are well known in the prior art, or without spacers allowing the hammers to move horizontally on the rod.

Figure 8:
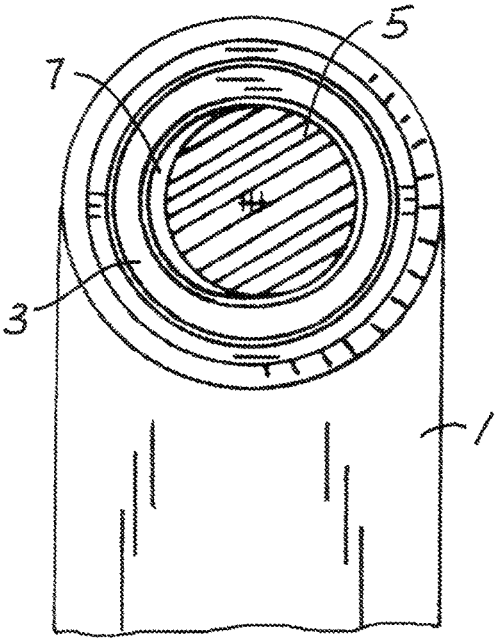
FIG. 8 illustrates a preferred embodiment of a hammer wherein the circular bearing 3 has rotated during installation, start-up, removal or operation of the mill, to an orientation wherein the oval rod hole 7 in the bearing is oriented cross-wise of the connection end.

The hammer rod as shown in FIG. 2 is positioned in the first section or cut 8 of the oval shaped hole 7 in the inside of bearing 3. However, it is to be understood that the bearing is free to rotate during installation of the hammer, during start-up of the hammer mill, and/or during operation of the hammer mill, and the hammer rod 5 may end up positioned in the second section or cut 9, or for a time between the first or second circular sections or cuts as illustrated in FIG. 8.

Figure 3:
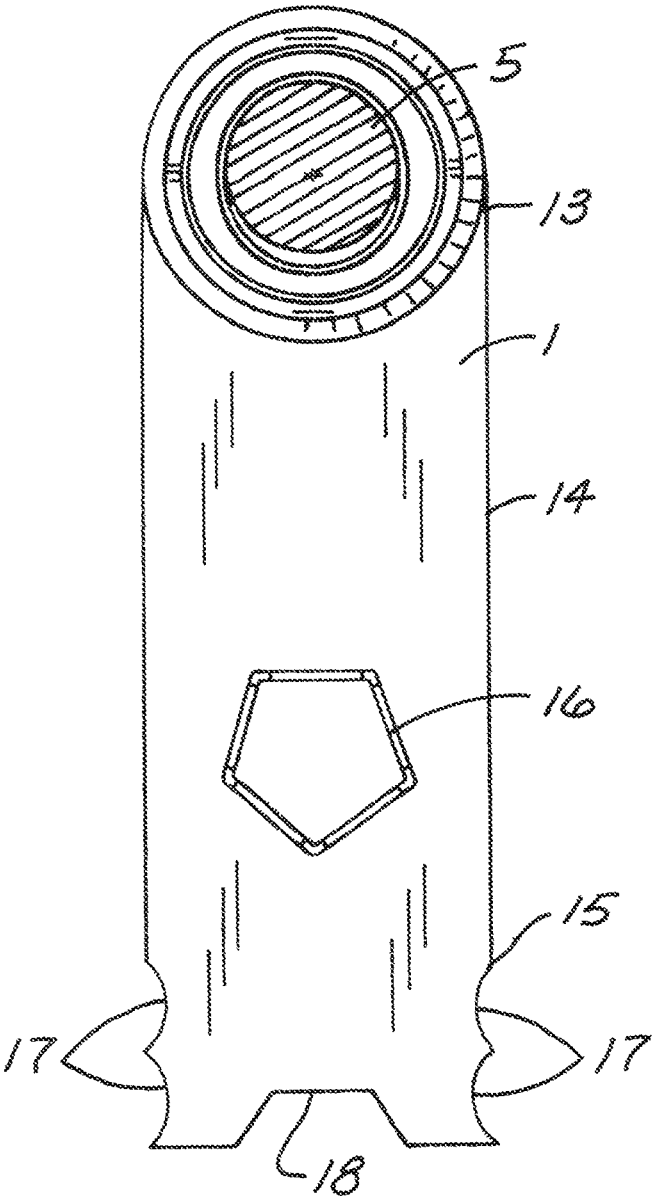
FIG. 3 is a view of an embodiment of the inventive hammermill hammer, presented end on to the axis of the hammer rod 5. The connection end 13 of the hammer 1 is identical to the connection end illustrated in FIG. 2. The hammer 1 as illustrated in FIG. 3 includes a neck portion 14 extending from the connection end 13 to the contact end 15; a pentagon shaped weight reduction hole 16 in the neck portion 14. The contact end 15 includes scalloped side edges 17, and a notch 19 in the bottom edge, formed in the shape of the top portion of a pentagon weight reduction hole. The hammer need not have a notch in the bottom edge. The notch in the bottom edge of the contact end may also be in the form of a scallop. The pentagonal shaped weight reduction hole 16 may be oriented differently from that shown in FIG. 3.

FIG. 3 is a side view of an embodiment of present inventive hammermill hammer, presented end on to the axis of the hammer rod 5. The connection end 13 of the hammer 1 is identical to the connection end illustrated in FIG. 2. The hammer 1 illustrated in FIG. 3 includes a neck portion 14 extending from the connection end 13 to the contact end 15; a pentagon shaped weight reduction hole 16 in the neck portion 14. The contact end 15 includes scalloped side edges 17, and a notch 18 in the bottom edge, formed in the shape of the top portion of a pentagon. The notch 18 is shown in the shape of the top portion of the pentagon weight reduction hole 16. The notch 18 improves comminution by providing additional surfaces for contacting material to be comminuted and also rebound of material within the notch 18.

The notch 18 need not be shaped as shown, and can be in the form of a scallop. The hammer need not have a notch in the bottom edge. The pentagonal shaped weight reduction hole 16 may be oriented differently from that shown in FIG. 3.

Figure 4:
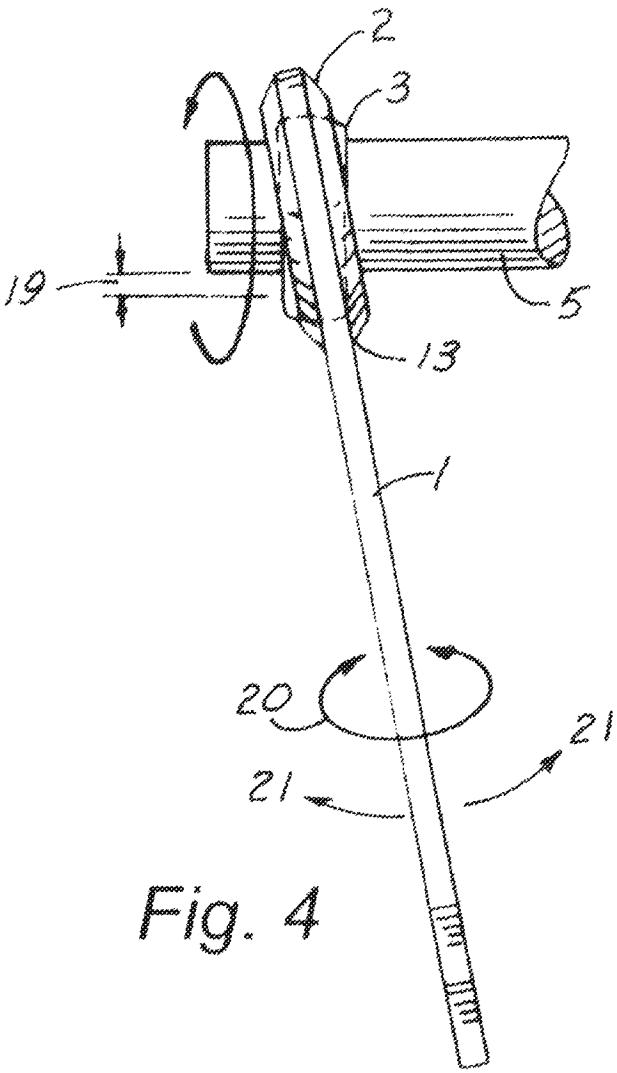
FIG. 4 illustrates an edge-on view of hammer 1 perpendicular to the hammer rod 5 of a hammer, such as shown in embodiment illustrated in FIG. 3, mounted on hammer rod 5.

FIG. 4 is an edge-on view of the inventive hammer 1 taken perpendicular to the hammer rod 5. The hammer is identical to the inventive hammer shown in FIG. 3. The hammer 1 is shown mounted on a hammer rod 5. As illustrated in FIG. 4, the hammer connection end 13 has a circular bearing race 2 with a circular bearing 3 received therein, which circular bearing 3 has an non-circular, oval, elliptical, egg-shaped or elongated inner hole or bearing race (as shown in FIG. 2) which receives hammer rod 5. As illustrated in FIG. 4, the bearing race-bearing-non-circular bearing rod hole, permits not only rotation of the hammer in a radial plane perpendicular to the axis of the hammer rod, but also limited rotation about the radial centerline axis of the hammer as shown by arrow 20, and limited swing as shown by arrows 21 in an axial direction in response to forces applied by material passing through the hammermill.

Figure 5:
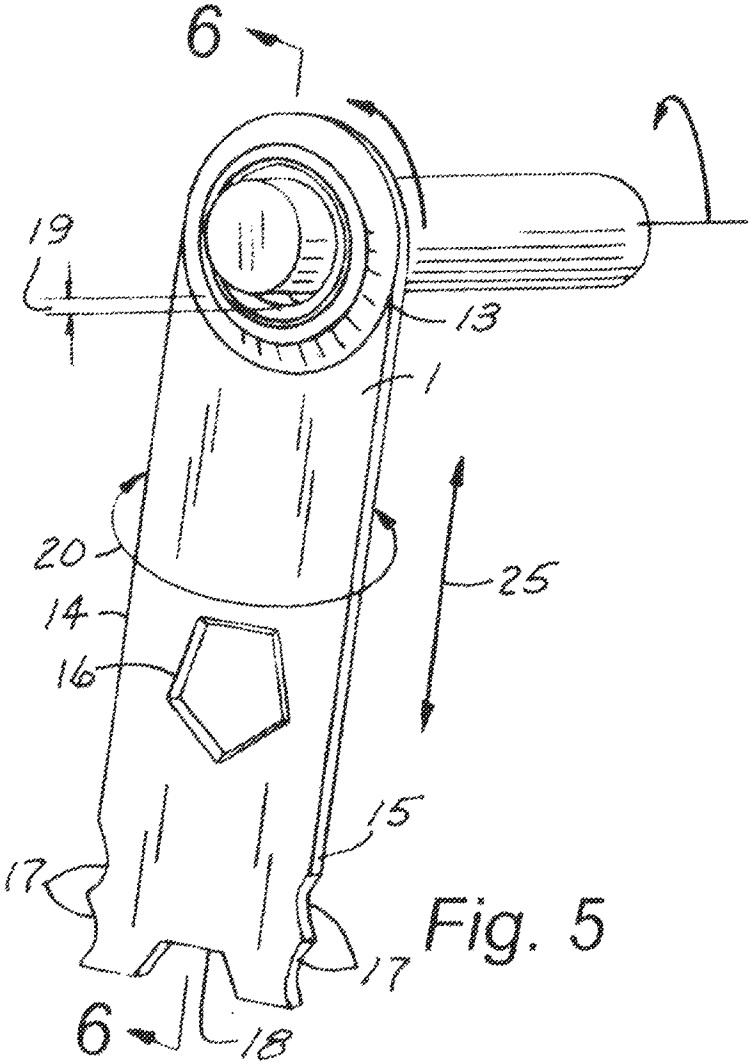
FIG. 5 shows an angled view of the hammer 1 identical to the hammer in FIGS. 3 and 4. The connection end 13 identical to that shown in FIGS. 2 to 3. The hammer 1 has a neck portion 14 extending from the connection end 13 to the contact end 15. The neck portion 14 has a pentagon shaped weight reduction hole 16, which may be oriented differently from that shown in FIG. 5, be a different shape or not be in the hammer at all. The contact end 15 has scalloped contact side edges 17, which can have more than two scalloped portions on each side edge. The bottom edge has a notch 18 formed in the shape of the top portion of the pentagon 16. The bottom edge of the contact end may not have a notch; and, alternatively may have a scalloped shaped notch. The connection end 13 of the hammer includes a circular bearing received in a circular bearing race. The rod hole in the inside of the bearing 3 is oval in shape and formed by first and second circular sections or cuts, as shown in FIG. 2. The first and second circular sections or cuts are offset from each other, as indicated at 19. The combination of the bearing race-bearing-oval/non-circular rod hole permits the hammer to (1) rotate in the plane perpendicular to the axis of the hammer rod 5; (2) to rotate to a limited extend about the radial axis of the hammer as shown by arrow 20; and, (3) to swing a limited extent in the direction of flow of material being comminuted in response to forces applied by material passing through the hammer mill, as shown by arrows 21 in FIGS. 4 and 6.

FIG. 5 shows an angled view of the hammer 1 identical to the hammer in FIGS. 3 and 4. The connection end 13 is identical to that shown in FIGS. 2 to 3. The hammer 1 has a neck portion 14 extending from the connection end 13 to the contact end 15. The neck portion 14 has a pentagon shaped weight reduction hole 16, which may be oriented differently from that shown in FIG. 5. The contact end 15 has scalloped contact side edges 17, which can have more than two scalloped portions on each side edge. The contact end 15 can also have a single scalloped portion on the side edges of the contact end. The bottom edge has a notch 18 formed in the shape of the top portion of the pentagon 16. The bottom edge of the contact end can alternatively have a scalloped shaped notch, or no notch at all. However, the notch provides the benefit of enhanced comminution of the material being comminuted, by providing additional surfaces for contacting the material and providing rebounding of the material within the notch.

The connection end 13 of the hammer includes a circular bearing received in a circular bearing race. The rod hole in the inside of the bearing 3 is oval in shape and formed by a first and second circular sections or cuts, as shown in FIG. 2. The first and second circular sections or cuts are offset from each other, as indicated at by lines 22. The combination of the bearing race-bearing non-circular rod hole permits the hammer (1) to rotate in a plane perpendicular to the axis of the hammer rod 5, (2) to have limited rotation about the radial axis of the hammer itself as shown by arrow 20, and (3) to swing to a limited in the axial direction in response to forces applied by material passing through the hammer mill (see arrows 21 in FIG. 4. The non-circular shape of the inner bearing race or rod hole 7 allows the hammer to also move to small extent in the direction indicated by arrow 25. The rotation of the hammer in a plane perpendicular to the axis of the hammer rod as indicated by the arrow 24, the limited movement indicated by arrow 25, the limited rotation shown by arrow 20 and the limited swing in the direction of movement of material through the hammermill as indicated by arrow 21, reduce wear and enhance hammer life by permitting the hammers to move in response to forces applied by the material being comminuted and any foreign material, such as tramp metal, entering the hammermill.

FIG. 6 shows an edge-on view of two of the inventive hammers, the left one of which is partially cut away along the center of the hammer and the hammer rod. The lines indicated at arrows 22, show the amount of offset of the first circular section or cut from the second circular section or cut, which offset results in formation of the oval rod hole 7 in the circular bearing 3. The arrows 21 illustrate the limited axial motion of the hammer provided by the combination of the circular bearing race-circular bearing-oval rod hole in the inside of the circular bearing. The arrow 20 shown in FIG. 5 illustrates the limited rotation about the axis of the hammer provided by the combination of the circular bearing race-circular bearing-oval rod hole in the inside of the circular bearing. The cut away of the pentagon shaped weight reduction hole is shown at 16. The cut away of the notch is shown at 17.

Figure 7A:
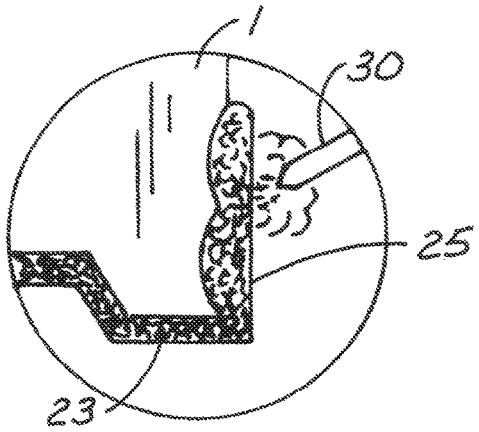
FIG. 7A is an enlarged portion of the circled part of FIG. 7 and shows the tip 30 of a welder applying tungsten carbide to scalloped depressions in the hammer 15.

FIG. 7 illustrates a preferred embodiment of the inventive hammer wherein the contact end 15 of the hammer has scalloped side edges 17 and the bottom edge 23 and notch 18 in the bottom edge. The scalloped edges 17, the bottom edge 23 and the notch 18 have hardened material 25, such as tungsten carbide, welded thereon. The hardened material 25 is of a thickness that it fills scalloped portions 17. The thickness of the hardened material 24 may, as shown in FIG. 7, be greater than the depth of the scalloped portions 17, to provide an additional protective layer over the filled scalloped portions. The hardened material enhances the comminution properties of the hammer, the wear resistance, and working life of the hammer. FIG. 7A is an enlarged portion of the circled portion of FIG. 7 and shows the tip 30 of a welder applying tungsten carbide to scalloped depressions in the hammer 15;

FIG. 8 illustrates a preferred embodiment of a inventive hammer wherein the circular bearing 3 has rotated during installation, start-up, removal or operation of the mill, to an orientation wherein the oval rod hole 7 in the bearing is oriented cross-wise of the connection end. The bearing is of course free to rotate during installation, removal, and start-up of the hammermill. When the hammermill is in operation, in one embodiment of the present invention, the loading of the bearing on the hammer rod can reduce or prevent rotation of the bearing about the hammer rod.

Figure 9:
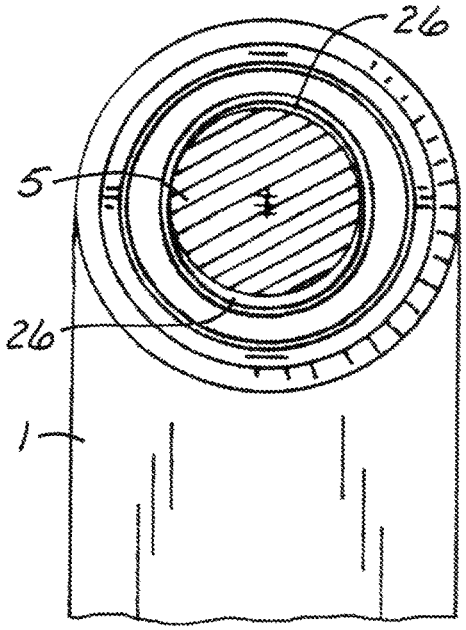
FIG. 9 illustrates an embodiment of the hammer wherein the rod hole 7 is elliptical and the hammer rod 5 is circular and has a radius size such that it cannot reach to the top or bottom of the rod hole resulting in arcuate gaps 26 at the top and bottom of the rod hole.

FIG. 9 illustrates an embodiment of the hammer wherein the rod hole 7 is elliptical and the hammer rod 5 is circular and has a radius size such that it cannot reach to the top or bottom of the rod hole resulting in arcuate gaps 26 at the top and bottom of the rod hole.

Figure 10:
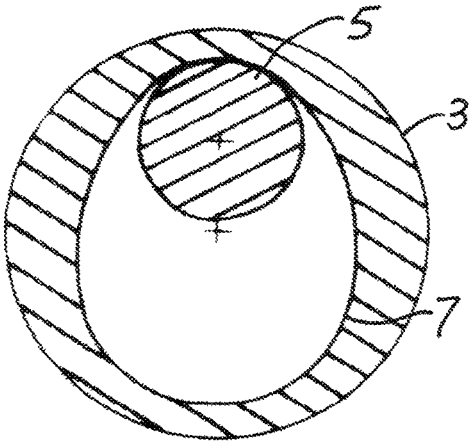
FIG. 10 illustrates an embodiment of the present invention wherein the rod hole formed by the inner bearing race 7 of circular bearing 3 is egg-shaped. The curvature of the egg-shaped rod hole can, as shown in FIG. 10, have a radius at the small end, indicated at tangential line 27, such that the hammer rod contacts the inner bearing race 7. The radius of curvature of the small end of the egg-shaped rod hole can also have a radius such that the hammer rod does not touch the inner bearing race.
Figure 11:
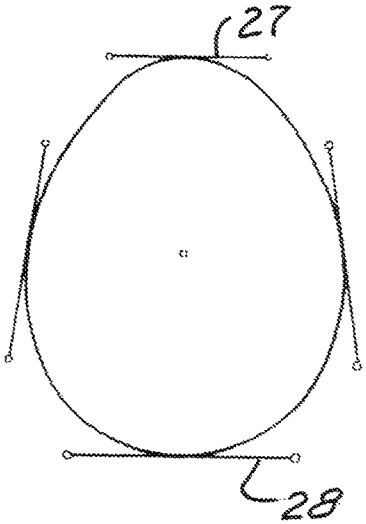
FIG. 11 illustrates the egg-shape of the inner bearing race and rod hole 7 in FIG. 10. The small end of the egg-shape indicated by tangential line 27 has a smaller arcuate radius than the large end indicated by the tangential line 28.

FIG. 10 illustrates an embodiment of the present invention wherein the rod hole formed by the inner bearing race 7 of circular bearing 3 is egg-shaped like the shape shown in FIG. 11. The curvature of the egg-shaped rod hole can, as shown in FIG. 10, have a radius at the small end, indicated at tangential line 27, such that the hammer rod contacts the inner bearing race 7. The radius of curvature of the small end of the egg-shaped rod hole can also have a radius such that the hammer rod does not touch the inner bearing race. The egg-shape of the inside 7 of the inner bearing race 3 of FIG. 10 is shown in FIG. 11. The small end of the egg-shape indicated by tangential line 27 has a smaller arcuate radius than the large end indicated by the tangential line 28.

Those skilled in the art will recognize that a wide variety of modifications, alterations, and combinations can be made with respect to the above described embodiments without departing from the spirit and scope of the preferred embodiment, and that such modifications, alterations, and combinations are to be viewed as being within the ambit of the inventive concept as expressed by the attached claims. For example, the bearing is preferably made of carbon steel, such as 1030, 1040, 52100 or similar carbon steel. The hammer mill blade is preferably formed by casting. However, the hammer mill blade may be manufactured by forging to required dimensions, coining the hammer blade for tolerances, and punching out the weight reduction hole and notch. The hammer blade is cast or forged with cylindrical hole with an excess of material around the cylindrical hole to form a circular bearing race in the connection end of the hammer body. The first step in assembling the hammer is to heat the hammer, thus permitting the cooled circular bearing to be inserted in the cylindrical hole in the hammer connection end. The excess material is then formed into the bearing race in the connection end of the hammer body, which bearing race then holds the inserted bearing.

The excess material can be formed into the bearing race in the connection end of the hammer body by heating and forging. The formed hammer with the bearing in the bearing race in the connection end of the hammer may next be subjected to heat treating. The heat treatment creates expansion and contraction of throughout the hammer body, thus relieving stresses in the hammer. The hammer blade may rotate about the oval, non-circular, rod hole or oval inner bearing race in the inside of the circular bearing. The oval rod hole or oval inner bearing race permit the axial and radial movement, and circular rotation about the hammer rod, even if the bearing is initially so tight in the bearing race in the hammer body that the bearing does not easily rotated in the bearing race in the hammer body. However, the inner bearing would, where initially tightly received in the outer bearing race, rotate when the hammermill is in operation, due to loading forces during start up and operation.

What is claimed is:

1. A hammermill hammer having a connection end comprising:

(a) a bearing race;

(b) a bearing received in the bearing race; and (c) an inner race in the bearing for receiving a hammer rod, wherein the inner race is non-circular and is formed from a first arcuate section and a second arcuate section, which arcuate sections are offset from each other and are connected on both sides by linking portions having a length of the offset.

2. The hammermill hammer of claim 1, wherein the linking portions are straight portions having a length of the offset.

3. The hammermill hammer of claim 1, wherein the linking portions are convexly arcuate portions, having a length approximating the length of the offset.

4. The hammermill hammer of claim 1, which includes a circular hammer rod disposed in said inner race, whereby the combination, allows the hammer to rotate about the hammer rod in a plane perpendicular to the axis of the hammer rod, limited rotation about the axis of the hammer, and limited swing in the direction of movement of material passing through the hammermill.

5. The hammermill hammer of claim 4, wherein the radii of the first arcuate section and second arcuate section are approximately the same radius as the hammer rod.

6. An improved hammermill hammer comprising:

(a) a neck portion connecting a connection end of the hammer, which receives a hammer rod, and a contacting end of the hammer for contacting and comminuting material in the hammermill;

(b) a bearing race in the connection end of the hammer;

(c) a bearing received in the bearing race; and (d) an oval hole in the inside of the bearing, formed from first and second arcuate sections, which arcuate sections are offset from each other and are connected on both sides by slightly convexly arcuate portions, which convexly arcuate portions have a length approximating the length of the offset;

(e) scalloped portions on the side edges of the contact end of the hammer; and (f) a notch in the bottom edge of the contact end of the hammer.

7. The improved hammermill hammer of claim 6, including a pentagon shaped weight reduction hole and wherein the notch in the bottom edge of the contact end of the hammer is in the shape of a portion of a pentagon.

8. The improved hammermill hammer of claim 6, wherein the notch in the bottom edge of the contact end of the hammer is scalloped shaped.

9. The improved hammermill hammer of claim 6, wherein the scalloped side edges are filled with hardened material.

10. The improved hammermill hammer of claim 6, wherein the scalloped side edges are filled with welded on tungsten carbide.

11. The improved hammermill hammer of claim 10, wherein a layer of tungsten carbide is welded on the side edges of the contact end of the hammer, and a layer of tungsten carbide is applied over the scalloped side edges in addition to the tungsten carbide filling the scallops.

12. The improved hammermill hammer of claim 6, where in the bottom edge of the hammer and the notch in the contact end of the hammer are covered with hardened material.

13. The improved hammermill hammer of claim 12, wherein the hardened material is welded on tungsten carbide.

14. A hammermill hammer having an improved connection end having a hammer rod received in the connection end, the connection end comprising:

(a) an outer bearing race in the connection end of the hammer body;

(b) a bearing received in the bearing race;

(c) a non-circular rod hole in the inside of the bearing, wherein the non-circular rod hole is oval in shape and is formed from first and second arcuate sections, which arcuate sections are offset from each other and are connected on both sides by straight portions having a length approximating the length of the offset; and, (d) a hammer rod received in the non-circular rod hole in the inside of the bearing.

15. The hammermill hammer of claim 14, wherein the radii of the first and second arcuate sections are approximately equal to the radius of the hammer rod.

16. A hammermill hammer having a connection end and a contact end, and a neck connecting the two ends, the connection end comprising:

a bearing race in the connection end of the hammer;

a bearing received in the bearing race;

a non-circular inner race in the bearing, which inner race forms a hammer rod hole for receiving a hammer rod;

wherein the bearing can rotate in the bearing race in the connection end of the hammer; and wherein the inner bearing race is oval and each end of the oval inner bearing race has an arc having a radius which is substantially equal to the radius of the hammer rod.

17. The hammermill hammer of claim 16, wherein the oval inner bearing race provides, during operation, a gap at the end of the oval inner bearing race, which gap is not in contact with the hammer rod.

18. The hammermill hammer of claim 16, wherein the inner bearing race is oval and at least one end of the oval inner bearing race has an arc of a radius slightly greater than the radius of the hammer rod.

19. The hammermill hammer of claim 16, wherein the inner bearing race is oval and at least one end of the oval inner bearing race has an arc with a radius slightly less than the radius of the hammer rod.

20. The hammermill hammer of claim 16, wherein the hammer rod hole is elliptical and the hammer rod is circular and has a radius size such that there is a gap in at least one of the top and bottom of the hammer rod hole and the hammer rod does not contact the rod hole at least one of said top and bottom of said hammer rod hole.

21. A hammer mill hammer blade assembly comprising:

(a) a hammer blade body;

(b) an inner bearing race;

(c) an outer bearing race stationary with respect to the hammer blade body;

(d) an outer surface of the inner bearing race being concentric to the outer bearing race; and (e) an inner surface of the inner bearing race being non-circular in shape and formed from a first arcuate section and a second arcuate section, which arcuate sections are offset from each other and connected on both sides by linking portions having a length approximating the length of the offset, the inner surface of the inner bearing racing being adapted to receive an hammer mill rod, the rod having a longitudinal axis about which the hammer blade body can rotate.

22. The hammer mill hammer assembly of claim 21, wherein the hammermill rod has a circular outer surface with a constant radius, one of the arcuate sections of the inner surface of the inner bearing race is formed around a radius which is approximately the same as the radius of the rod.

* * * * *